United States Patent [19]

Horn

[11] Patent Number: 4,681,785

[45] Date of Patent: Jul. 21, 1987

[54] SUPPLY ROLL FOR PROTECTIVE COVERS ESPECIALLY THOSE MADE OUT OF SHEET PLASTIC, FOR MOTOR-VEHICLE SEATS

[75] Inventor: Stephanie Horn, Schwalmstadt-Treysa, Fed. Rep. of Germany

[73] Assignee: Horn-Plastik Theodor Horn KG, Schwalmstadt, Fed. Rep. of Germany

[21] Appl. No.: 818,169

[22] Filed: Jan. 13, 1986

[30] Foreign Application Priority Data

Jan. 12, 1985 [DE] Fed. Rep. of Germany ..... 3500928

[51] Int. Cl.[4] ..... B32B 3/10

[52] U.S. Cl. ..... 428/43; 428/124; 428/130; 206/390; 206/395; 242/1

[58] Field of Search ..... 428/43, 906, 121, 130, 428/124, 126; 242/1; 206/390, 389, 395, 396, 410

[56] References Cited

U.S. PATENT DOCUMENTS

| | | | |
|---|---|---|---|
| 3,961,743 | 6/1976 | Hollowell | 206/390 X |
| 4,258,846 | 3/1981 | Campo | 428/906 X |
| 4,263,347 | 4/1981 | Banta | 206/389 X |

*Primary Examiner*—Alexander S. Thomas

*Attorney, Agent, or Firm*—Max Fogiel

[57] ABSTRACT

The invention concerns a supply roll for protective covers, especially those made out of sheet plastic, for motor-vehicle seats, wherein the covers can be separated at a perforation and are attached to each other across their length in a long web and folded over at the ends to form pockets that can be pulled out over the backrest or forward edge of the seat and the overall web is folded longitudinally between the seat and backrest components and finally wound into a supply roll, wherein in accordance with the invention the winding density of supply roll of wound seat covers is kept constant over its whole width by introducing a supporting fold.

2 Claims, 4 Drawing Figures

SUPPLY ROLL FOR PROTECTIVE COVERS ESPECIALLY THOSE MADE OUT OF SHEET PLASTIC, FOR MOTOR-VEHICLE SEATS

The invention concerns a supply roll for protective covers, especially those made out of sheet plastic, for motor-vehicle seats in accordance with the preamble to claim 1 and as employed in shops or storage facilities to protect the upholstery from dirt and damage. Since covers of this type are employed only once, an extensive supply must be kept on hand and supply rolls employed on which the individual seat covers are attached to each other across their length in a long web with a perforation between each pair so that they can easily be torn off the large roll as needed. Each protective cover is folded over at the ends to form pockets that can pulled out over the backrest or forward edge of the seat, and the overall web is folded longitudinally down the middle and wound in such a way as to produce a relatively short and each to handle supply roll, which is also called a compact roll. The drawback to rolls of this type as described for example in German Utility Model 8 023 722 is that, once the longitudinal fold has been produced and the web has been wound onto the roll, the layers vary in thickness at the ends of the roll to the detriment of the solidity and storage and shipping capacity of the overall roll and limiting the number of covers that can be wound onto it.

The object of the present invention is to provide an in itself rigid and strong roll of a large number of protective covers that can be torn apart at perforations and that is also easy to handle and store.

This object is attained in accordance with the invention in that the winding density of supply roll of wound seat covers is kept constant over its whole width by introducing a supporting fold. The fold compensates for the loss of superimposed layers that results from the different widths of the folds that constitute the backrest and front edge when the covers are rolled up, producing a supply roll that is in itself always rigid and strong and that will stand up to all the stresses encountered in handling and shipping such rolls. The result is a tightly wound and compact roll of a large number of protective covers that can easily be torn off the supply roll when used.

The supporting fold will usually be in the vicinity of the longitudinal fold in the web and on the side facing the front edge of the seat. The supporting fold can, however, also be replaced with an inserted strip that extends over the total length of the web.

Figure 3:
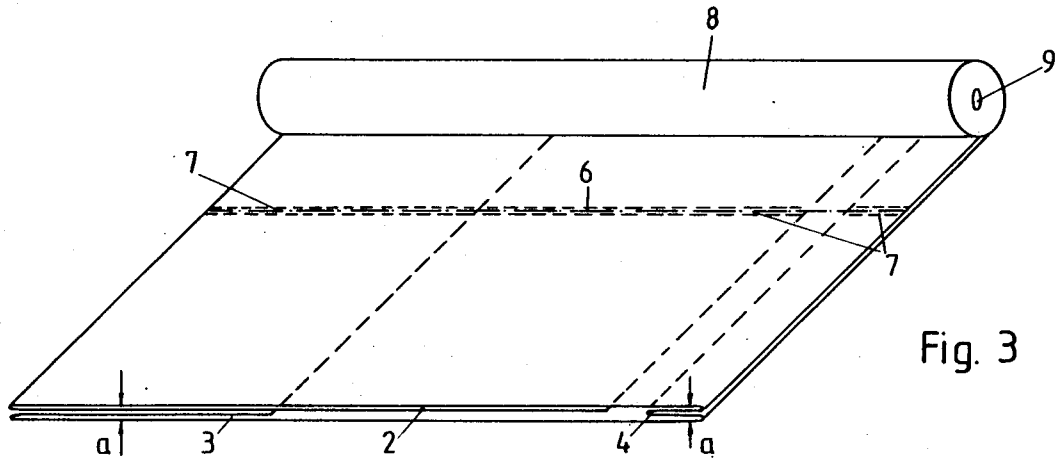
Figure 1:
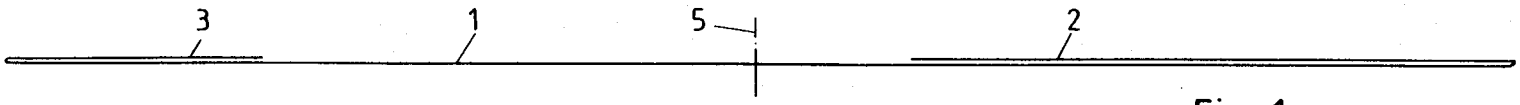
Figure 2:
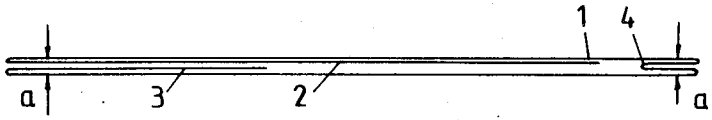
Figure 4:
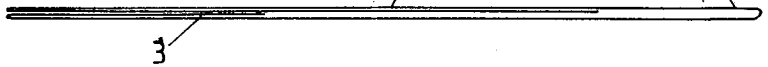

One embodiment of the invention will now be described with reference to the drawings, in which FIG. 1 illustrates a spread-out web of material that functions as a protective cover for the seat of a motor vehicle, FIG. 2 is a longitudinal section along the longitudinal creases provided in a seat cover, FIG. 3 is a perspective view of part of the supply roll, and FIG. 4 is a longitudinal section through a seat cover without the supporting fold in accordance with the invention.

The protective cover consists of a web 1 of thin sheet plastic, with a number of such webs attached across their longitudinal direction and with the individual webs connected by means of a welded separating seam 6 in such a way that they can easily be separated. Each web 1, which constitutes one cover, is folded over at the ends to form pockets 2 and 3 that extend across the web along separating seam 6 and between welded seams 7. The facing sides of pockets 2 and 3, so that the section with pocket 2 can be pulled over the backrest and the section with pocket 3 over the front edge of the seat. The overall web, consisting of attached blanks, is wound, subsequent to the establishment of a longitundinal crease 5 into a supply roll 8 on a core 9. Individual covers can easily be separated at perforation 6.

Since the sheet plastic employed is extremely thin, several hundred covering-material blanks can be stored on one supply roll. Since the pockets 2 and 3 at the ends of each web are of different dimensions, four layers of sheet plastic will be superimposed at one end of the overall web in the vicinity of pocket 3 and only two at the other edge once longitundinal crease 5 has been established, as will be evident from FIG. 4. Once a few hundred layers of sheet plastic have been wound onto the roll, consequently, the roll will be rigid and tight at one end (where four layers are superimposed) and flexible and loose at the other hand, which powerfully impedes the handling and storage of such rolls. A supporting fold 4 is accordingly introduced in accordance with the invention into the appropriate side of the web, so that the sheet plastic will now be fourfold at each longitudinal edge of the overall web, and supply roll 8 can be wound tight at each end. Supporting fold 4 can of course be eliminated if it is replaced by an inserted strip that extends over the whole length of the web. It is only important for supply roll 8 to be inherently tight and rigid at each end due to the supporting fold or inserted strip.

I claim:

1. A supply roll of protective covers made from sheet plastic for motor-vehicle seats comprising: covers attached to each other across their length in a long web and folded over at their ends to form pockets with a seam that can be pulled out over a backrest or forward edge of a seat; said seam comprising perforations between said covers for separating said covers from each other; said web having a length and width and being folded longitudinally to form a longitudinal fold between the pockets in said covers and said web being finally wound into a supply roll; and a supporting fold for holding constant the winding density of the supply roll of wound seat covers over its whole width, said supporting fold comprising additional folds of said cover and being located along the length of the web at the longitudinal fold.

2. A supply roll of protective covers made from sheet plastic for motor-vehicle seats comrising: covers attached to each other across their length in a long web and folded over at their ends to form pockets with a seam that can be pulled out over a backrest or forward edge of a seat; said seam comprising perforations between said covers for separating said covers from each other; said web having a length and width and being folded longitudinally to form a longitudinal fold between the pockets in said covers and said web being finally wound into a supply roll; and an inserted strip extending over the whole length of the web for holding constant the winding density of the supply roll of wound seat covers over its whole width, said inserted strip being located along the length of the web at the longitudinal edge opposite the pockets.

* * * * *